US011300256B2

(12) United States Patent
Boehmer

(10) Patent No.: US 11,300,256 B2
(45) **Date of Patent: *Apr. 12, 2022**

(54) TRAFFIC CONTROL SYSTEM WITH FLEXIBLE LED LIGHTED ASSEMBLY

(71) Applicant: Carl Boehmer, Blue Diamond, NV (US)

(72) Inventor: Carl Boehmer, Blue Diamond, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/917,617

(22) Filed: Jun. 30, 2020

(65) Prior Publication Data

US 2020/0332972 A1 Oct. 22, 2020

Related U.S. Application Data

(63) Continuation of application No. 16/255,110, filed on Jan. 23, 2019, now Pat. No. 10,731,804.
(Continued)

(51) Int. Cl.

| | |
|---|---|
| ***F21S 4/22*** | (2016.01) |
| ***F21V 15/015*** | (2006.01) |
| ***F21V 23/06*** | (2006.01) |
| ***F21V 7/10*** | (2006.01) |
| ***F21S 9/02*** | (2006.01) |
| ***F21V 27/00*** | (2006.01) |
| ***F21W 111/02*** | (2006.01) |
| ***F21Y 103/10*** | (2016.01) |
| ***F21Y 115/10*** | (2016.01) |

(52) U.S. Cl.
CPC . *F21S 4/22* (2016.01); *F21S 9/02* (2013.01); *F21V 7/10* (2013.01); *F21V 15/015* (2013.01); *F21V 23/06* (2013.01); *F21V 27/00* (2013.01); *F21W 2111/02* (2013.01); *F21Y 2103/10* (2016.08); *F21Y 2115/10* (2016.08)

(58) Field of Classification Search
CPC ..... F21S 4/00; F21S 4/10; F21S 4/15; F21S 4/20; F21S 4/22; F21S 4/24; F21S 4/26; F21S 4/28; F21S 9/02; F21Y 2103/10; F21W 2131/103
See application file for complete search history.

(56) References Cited

U.S. PATENT DOCUMENTS

| | | |
|---|---|---|
| 6,074,074 A | 6/2000 | Marcus |
| 6,113,248 A | 9/2000 | Mistopoulos et al. |

(Continued)

*Primary Examiner* — Matthew J. Peerce
(74) *Attorney, Agent, or Firm* — Howard & Howard Attorneys PLLC

(57) ABSTRACT

A lighting system is described herein. The lighting system includes a plurality of lighted strip assemblies coupled together. Each lighted strip assembly includes a flexible transparent housing including a housing cavity extending between a first open end and an opposite second open end and an LED light assembly positioned within the housing cavity and extending between the first open end and the second open end. The LED light assembly includes a plurality of LED light pods, with each LED light pod including a predefined number of LED lights. A connector assembly is coupled between adjacent lighted strip assemblies. The connector assembly includes a first connector cavity configured to receive a first adjacent lighted strip assembly and a second connector cavity is configured to receive a second adjacent lighted strip assembly.

18 Claims, 15 Drawing Sheets

Related U.S. Application Data

(60) Provisional application No. 62/621,292, filed on Jan. 24, 2018.

(56) References Cited

U.S. PATENT DOCUMENTS

| | | | | |
|---|---|---|---|---|
| 6,523,986 | B1 | 2/2003 | Hoffmann | |
| 6,776,504 | B2 * | 8/2004 | Sloan | F21S 8/032 362/147 |
| 7,144,139 | B2 * | 12/2006 | Kramer | E04F 19/06 362/368 |
| 8,215,786 | B2 * | 7/2012 | Sloan | F21V 23/06 362/145 |
| 8,262,250 | B2 * | 9/2012 | Li | F21V 23/06 362/219 |
| 9,285,084 | B2 | 3/2016 | Amrine, Jr. et al. | |
| 9,976,710 | B2 | 5/2018 | Meir | |
| 10,247,401 | B2 | 4/2019 | Noh et al. | |
| 2012/0182755 | A1 | 7/2012 | Wildner | |
| 2014/0140061 | A1 | 5/2014 | Sundholm | |
| 2014/0334142 | A1 * | 11/2014 | Levante | F21V 23/06 362/222 |
| 2016/0053977 | A1 | 2/2016 | Johannessen et al. | |
| 2017/0097128 | A1 * | 4/2017 | Stafford | F21S 4/22 |

* cited by examiner

TRAFFIC CONTROL SYSTEM WITH FLEXIBLE LED LIGHTED ASSEMBLY

CROSS-REFERENCE TO RELATED APPLICATIONS

This application is a continuation of U.S. Non-Provisional patent application Ser. No. 16/255,110, filed Jan. 23, 2019, which claims the benefit of U.S. Provisional Patent Application Ser. No. 62/621,292, filed on Jan. 24, 2018, the disclosures of which are hereby incorporated by reference in their entirety for all purposes.

TECHNICAL FIELD

This invention relates generally to traffic control systems, and more specifically, to traffic control systems having flexible LED light assemblies.

BACKGROUND OF THE INVENTION

In construction zones, at least some known traffic control systems include a plurality of traffic cones having reflective surfaces and/or electric signage that are positioned to alert drivers to changes in traffic route patterns. In addition, known traffic control systems may also include modular concrete and/or plastic barriers to separate lanes of traffic to established temporary traffic patterns. However, during evening hours, these known traffic control systems may become difficult to see by automobile drivers as the reflective surfaces become less effective as the sunlight fades. Accordingly, improvements to traffic control system visibility is needed.

SUMMARY OF THE INVENTION

In one embodiment of the present invention, a traffic control lighted strip assembly is provided. The traffic control lighted strip assembly includes a flexible transparent housing and a LED light assembly positioned within with the flexible transparent housing. The flexible transparent housing includes an inner surface that defines a support cavity extending between a first open end and a second opposite open end along a longitudinal axis. The LED light assembly is positioned within the support cavity and extends between the first open end and the second open end. The LED light assembly includes a plurality of LED light pods spaced along the longitudinal axis. Each LED light pod includes a predefined number of LED lights. An electrical quick connect coupler is coupled to an end of the LED light assembly for connecting the LED light assembly to a power source.

In another embodiment of the present invention, a traffic control lighted strip assembly is provided. The traffic control lighted strip assembly includes a flexible transparent housing and an LED light assembly positioned within the flexible transparent housing. The flexible transparent housing includes a housing body including a plurality of sidewalls extending between a first endwall and an opposite second endwall along a longitudinal axis, and extending between a first side and an opposite second side along a lateral axis that is perpendicular to the longitudinal axis. The housing body includes an inner surface and an outer surface. The inner surface defines a housing cavity that extends between a first open end defined at the first endwall and a second open end defined at the second endwall. The outer surface is formed of a flexible transparent material such that the housing cavity is viewable through the outer surface. The LED light assembly is positioned within the housing cavity and extends between the first open end and the second open end. The LED light assembly includes a plurality of LED light pods spaced along the longitudinal axis. Each LED light pod includes a predefined number of LED lights. An electrical quick connect coupler is coupled to an end of the LED light assembly for connecting the LED light assembly to a power source.

In a further embodiment, a traffic control system is provided. The traffic control system includes a support reel assembly and a traffic control lighted strip assembly adapted to be spooled about the support reel assembly. The traffic control lighted strip assembly includes a flexible transparent housing and an LED light assembly positioned within the flexible transparent housing. The flexible transparent housing includes a housing body including a plurality of sidewalls extending between a first endwall and an opposite second endwall along a longitudinal axis, and extending between a first side and an opposite second side along a lateral axis that is perpendicular to the longitudinal axis. The housing body includes an inner surface and an outer surface. The inner surface defines a housing cavity that extends between a first open end defined at the first endwall and a second open end defined at the second endwall. The outer surface is formed of a flexible transparent material such that the housing cavity is viewable through the outer surface. The LED light assembly is positioned within the housing cavity and extends between the first open end and the second open end. The LED light assembly includes a plurality of LED light pods spaced along the longitudinal axis. Each LED light pod includes a predefined number of LED lights. An electrical quick connect coupler is coupled to an end of the LED light assembly for connecting the LED light assembly to a power source.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION

Figure 1:
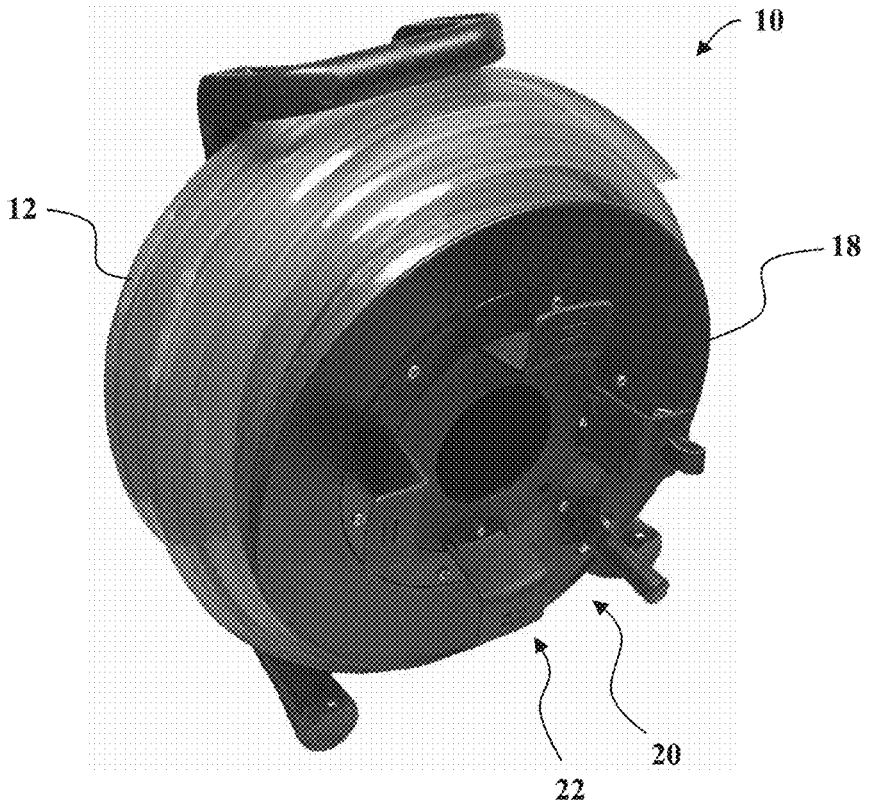
FIG. 1 is an perspective front view of a traffic control system including a traffic control lighted strip assembly and a portable support reel, according to an embodiment of the present invention.
Figure 2:
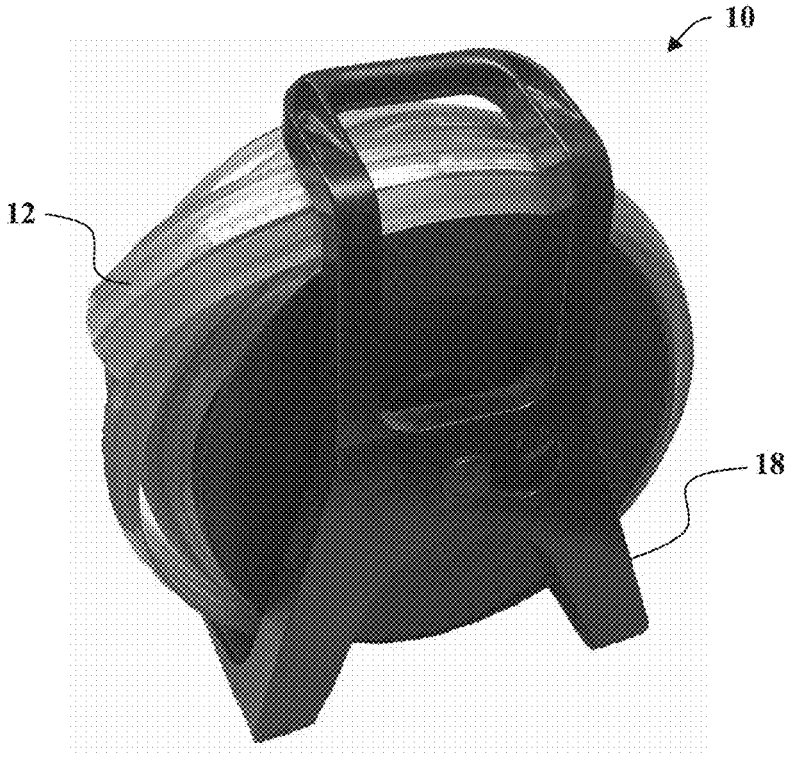
FIG. 2 is an perspective rear view of the traffic control system shown in FIG. 1.
Figure 3:
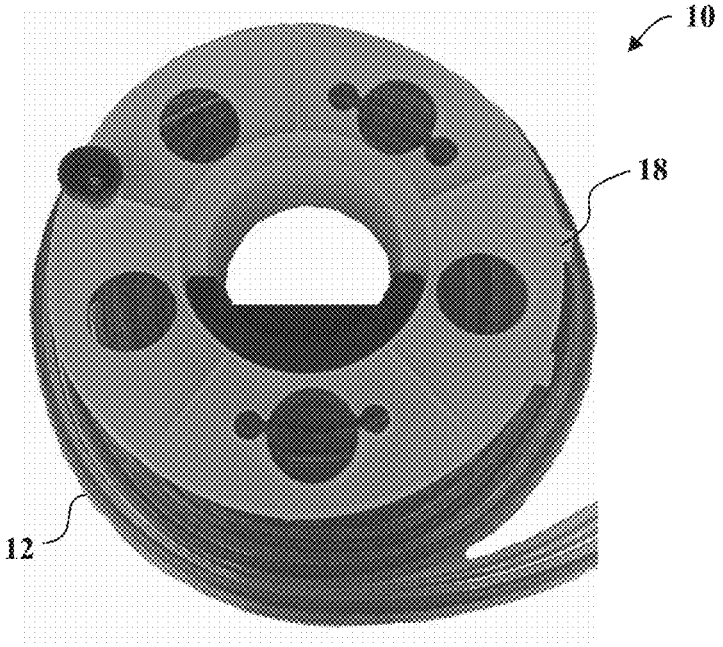
FIGS. 3-4 are perspective views of a traffic control system, according to an embodiment of the present invention.
Figure 4:
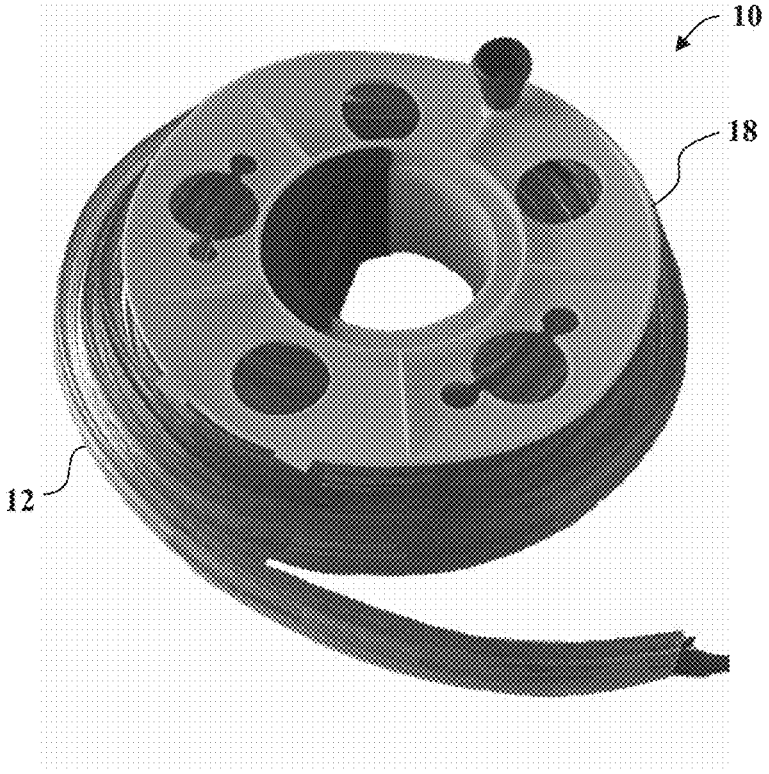
Figure 5:
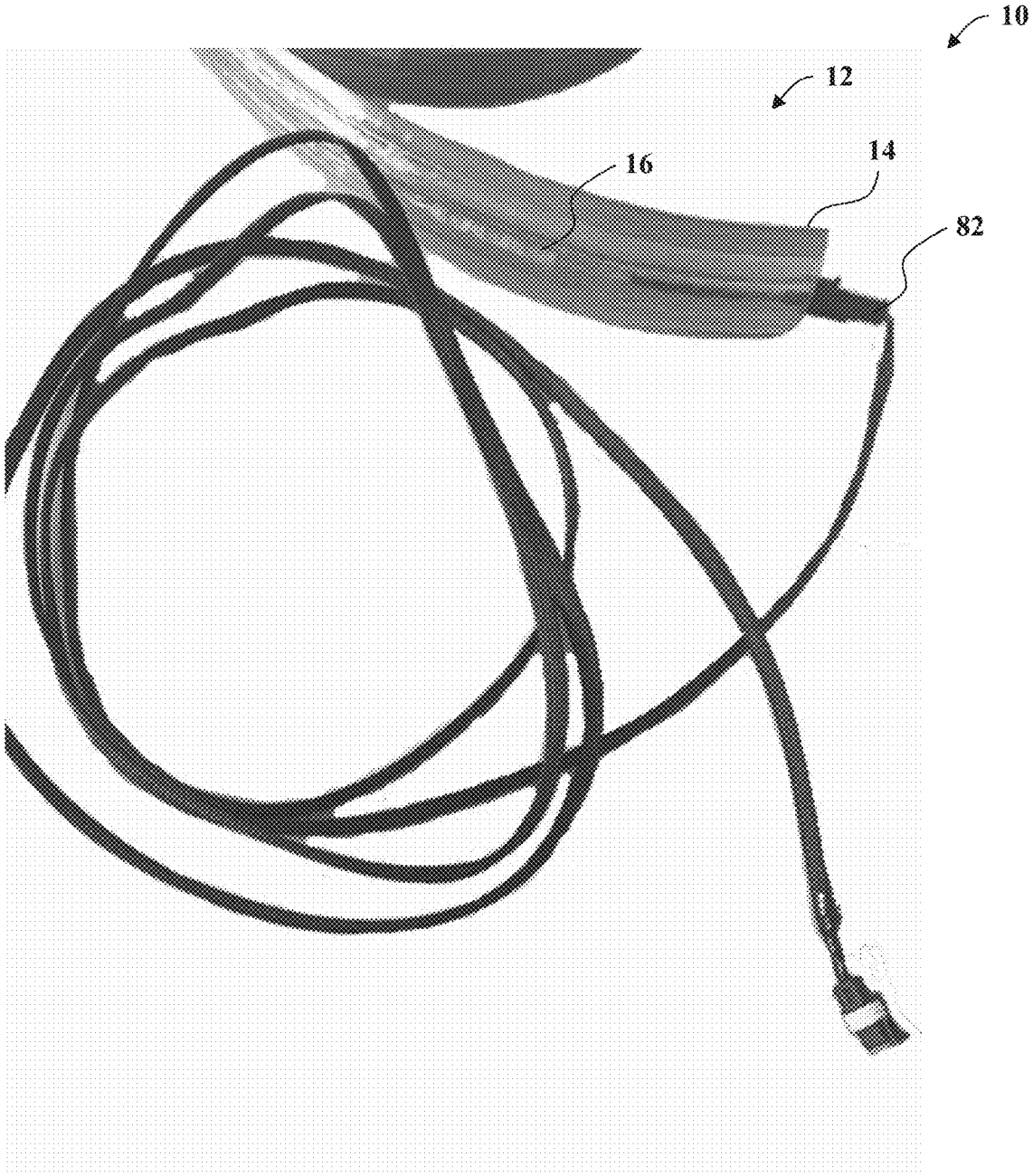
FIG. 5 is another perspective view of the traffic control system shown in FIG. 1 including the traffic control lighted strip assembly, an electrical quick connect assembly, and power cable, according to an embodiment of the present invention.
Figure 6:
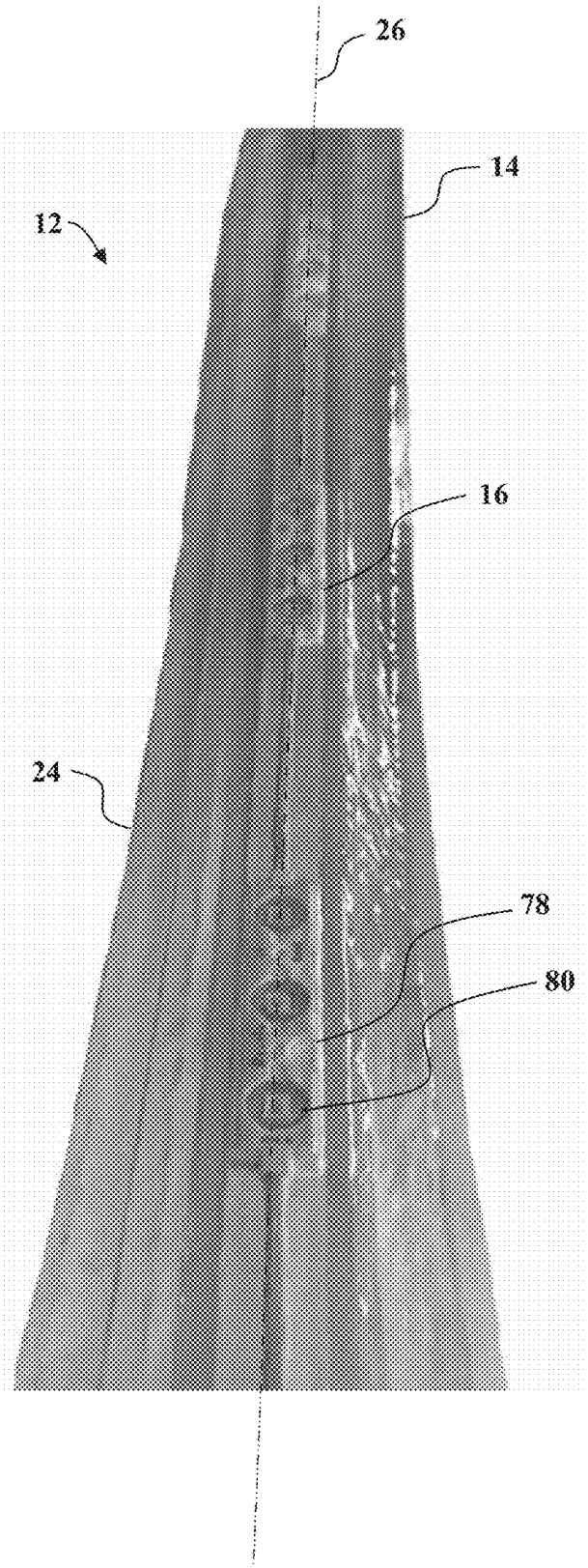
FIG. 6 is a perspective view of the traffic control lighted strip assembly show in FIG. 1.
Figure 7:
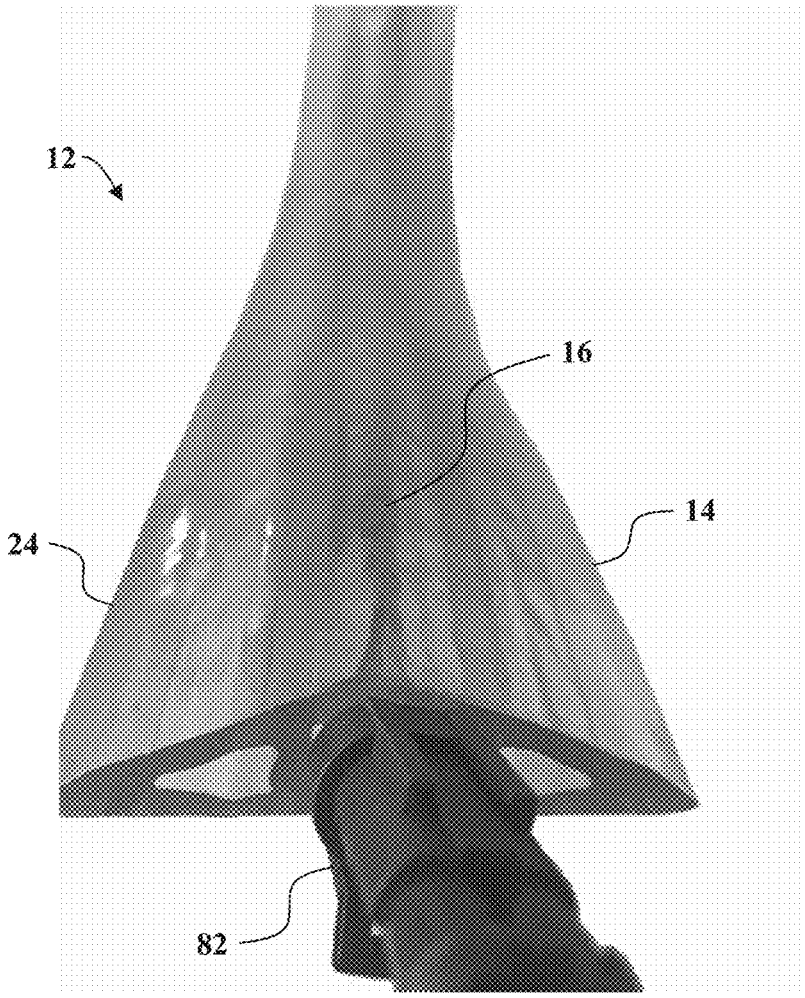
FIGS. 7-8 are perspective views of an end of the traffic control lighted strip assembly show in FIG. 1 illustrating a cross-sectional area of a flexible transparent support housing and an electrical quick connect assembly, according to an embodiment of the present invention.
Figure 8:
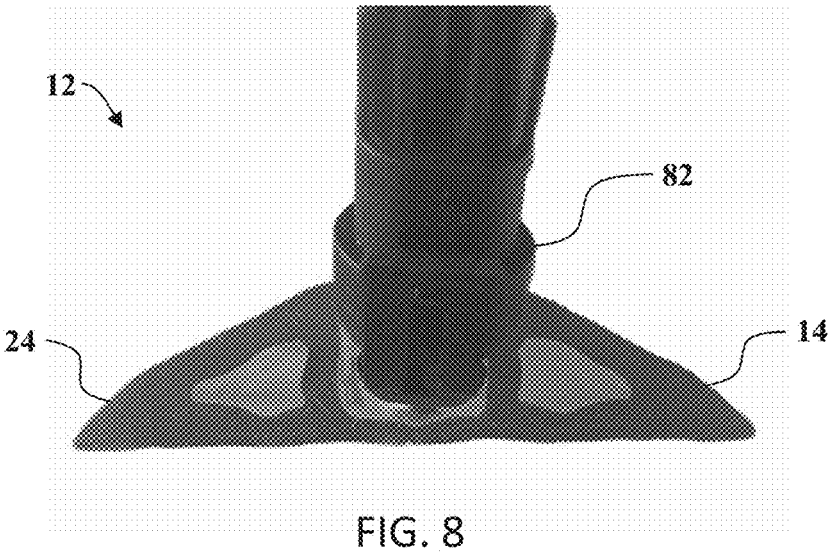
Figure 9:
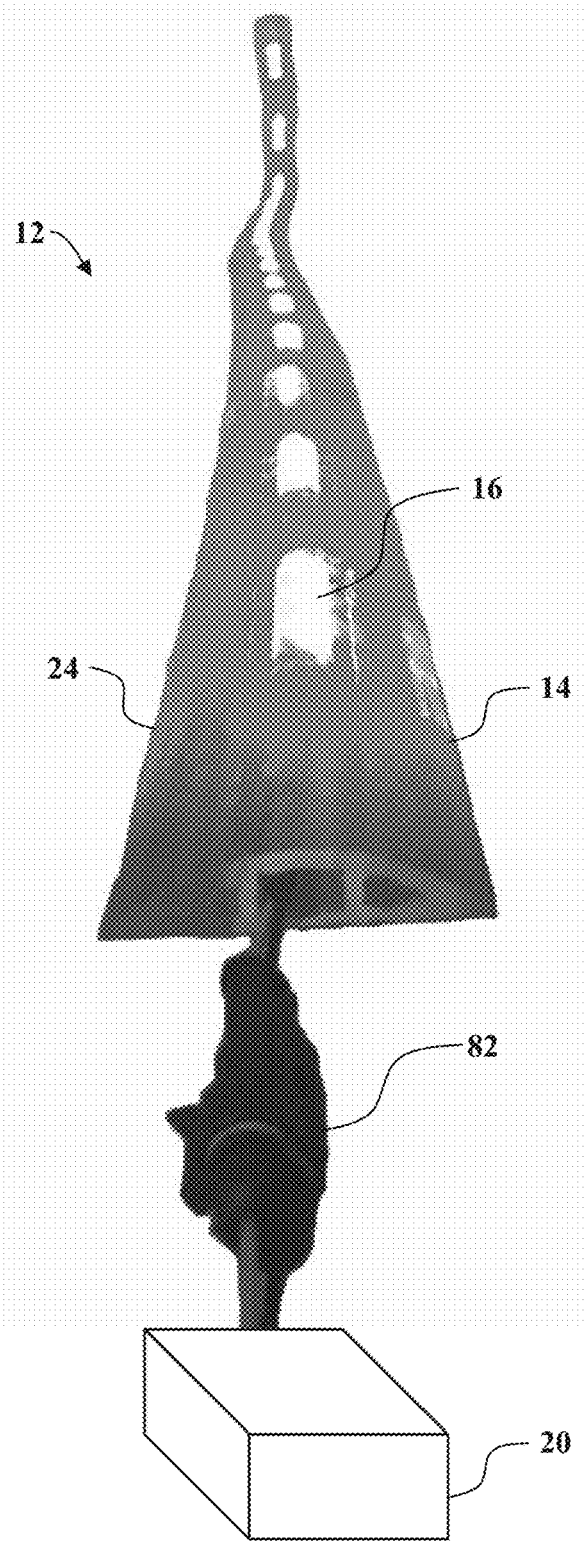
FIG. 9 is another perspective view of the traffic control lighted strip assembly show in FIG. 1.
Figure 10:
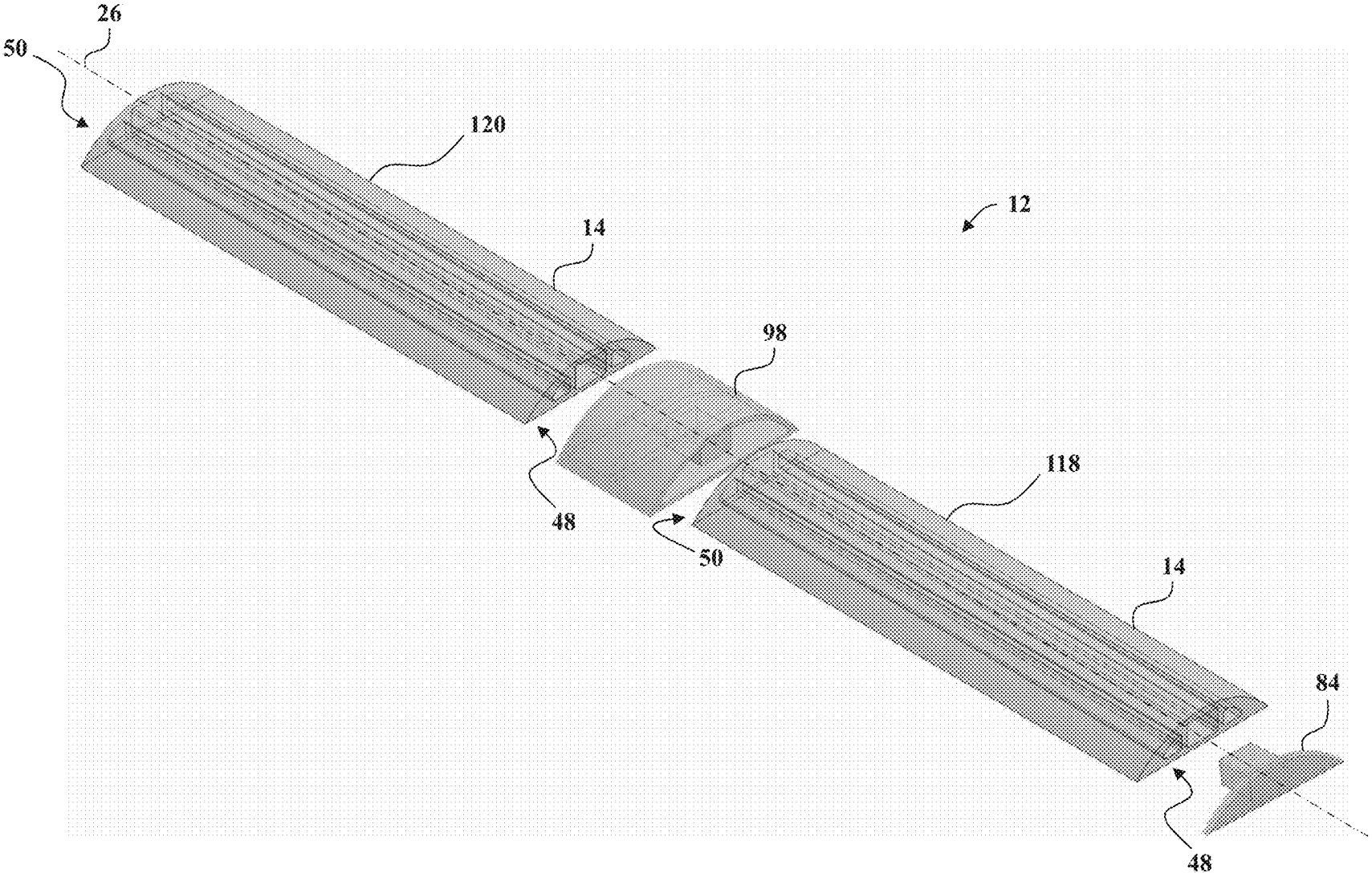
FIG. 10 is an exploded view of the traffic control lighted strip assembly show in FIG. 1, according to an embodiment of the present invention.
Figure 11:
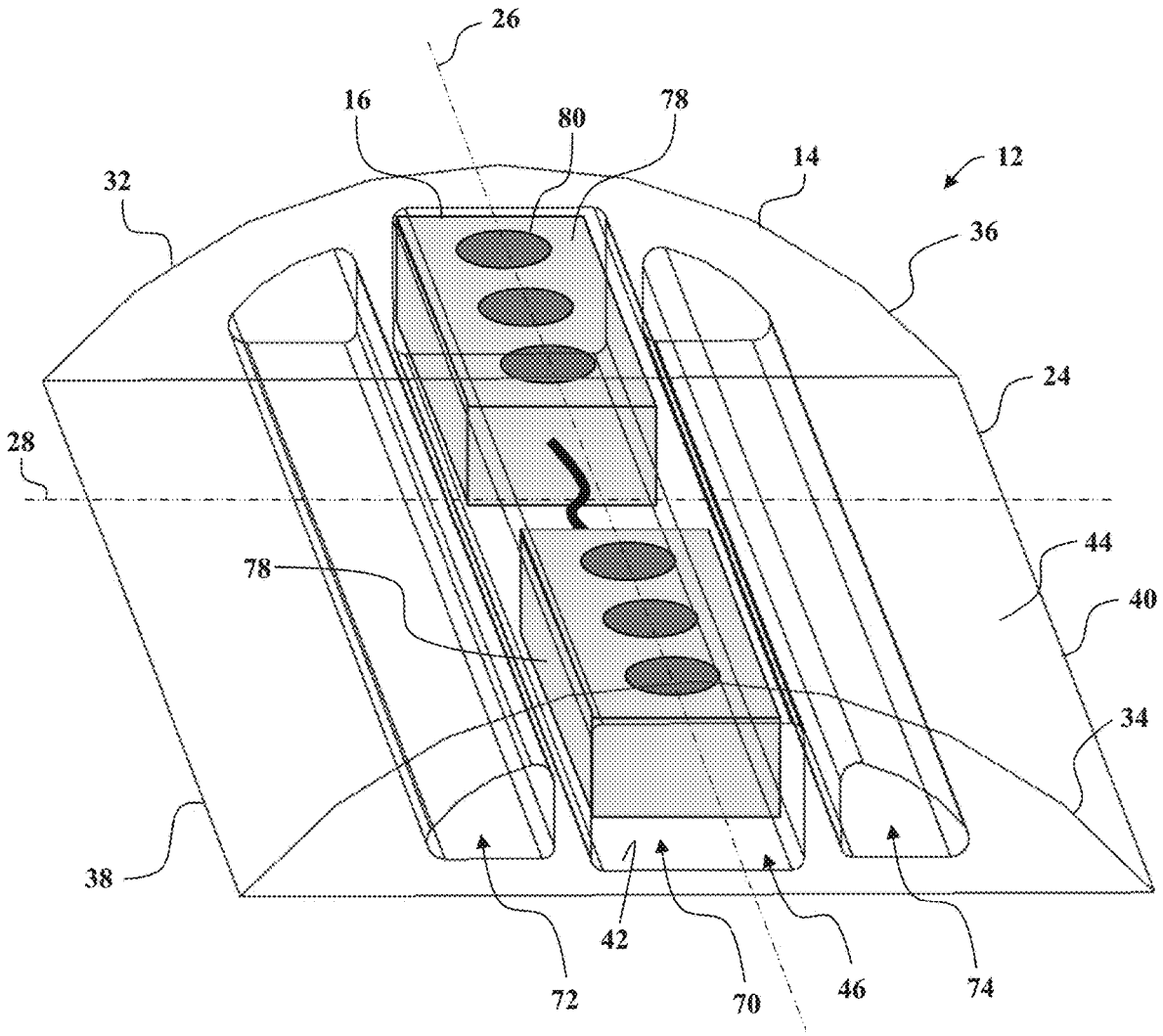
FIG. 11 is a sectional view of a portion of the traffic control lighted strip assembly show in FIG. 10.
Figure 12:
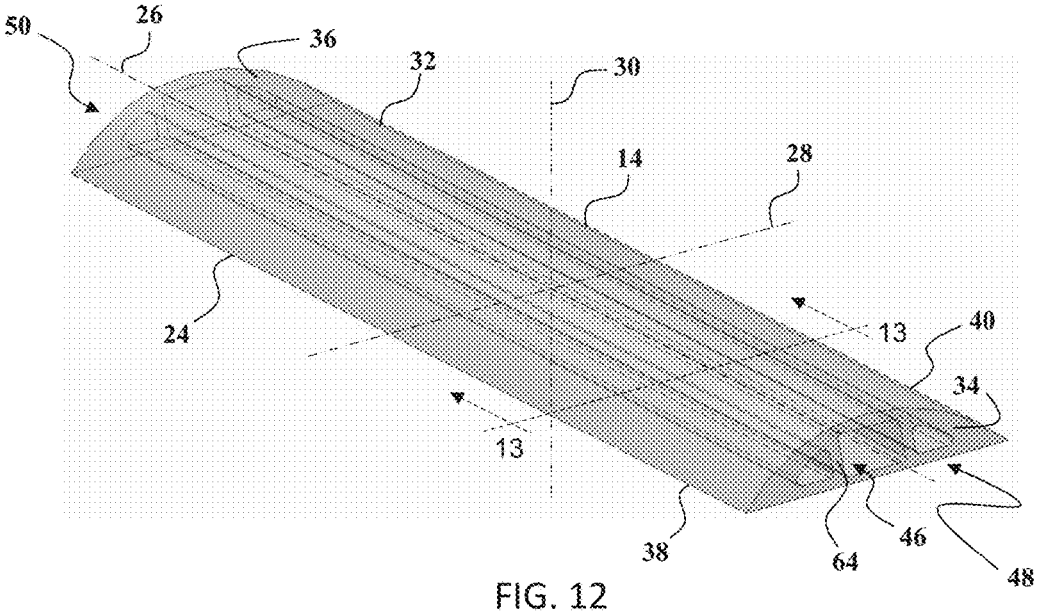
FIG. 12 is a perspective view of a flexible transparent housing that may be used with the traffic control lighted strip assembly show in FIG. 10.
Figure 13:
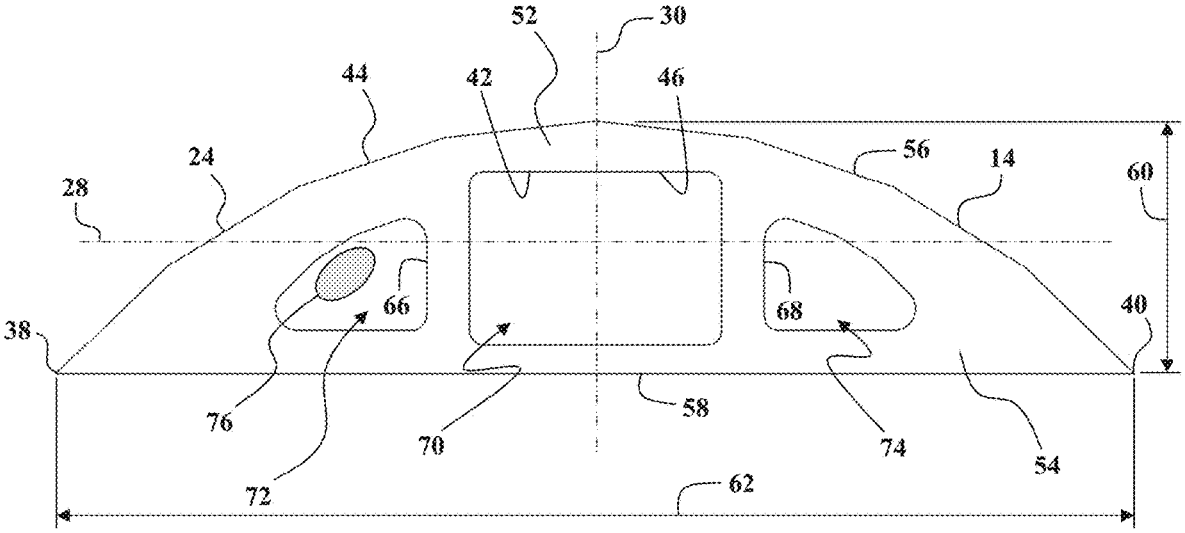
FIG. 13 is a sectional view of the flexible transparent housing shown in FIG. 12 taken along line 13-13.
Figure 14:
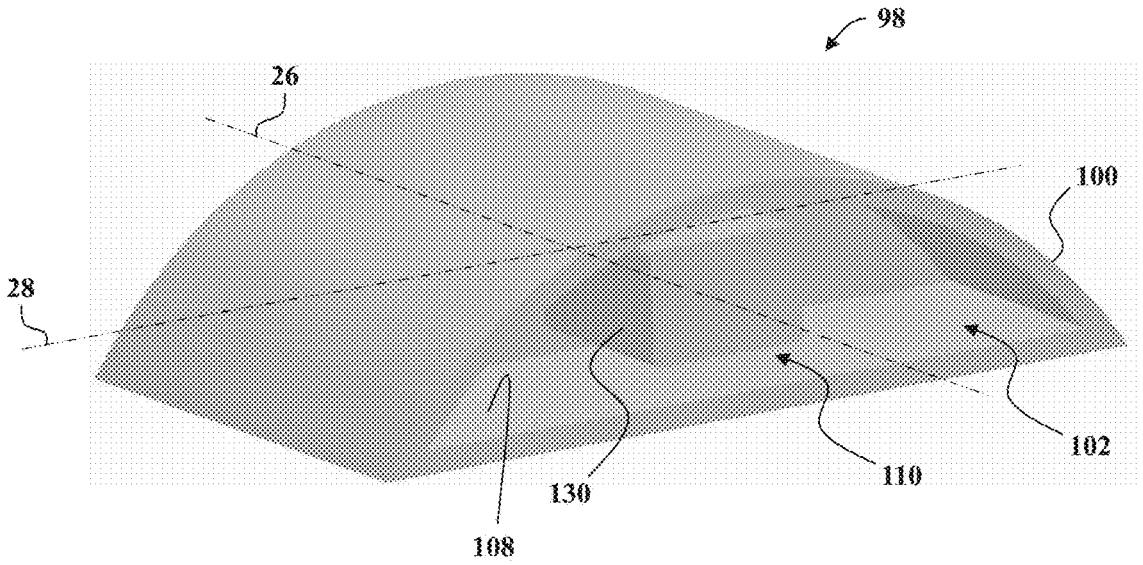
FIG. 14 is a perspective front view of a connector assembly that may be used with the traffic control lighted strip assembly show in FIG. 10.
Figure 15:
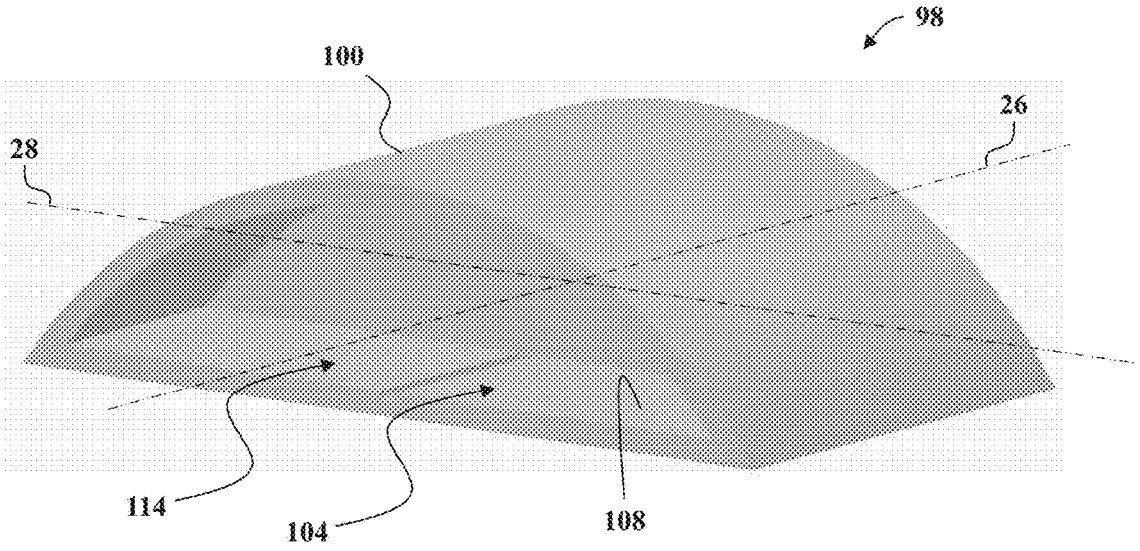
FIG. 15 is a perspective rear view of a connector assembly shown in FIG. 14.
Figure 16:
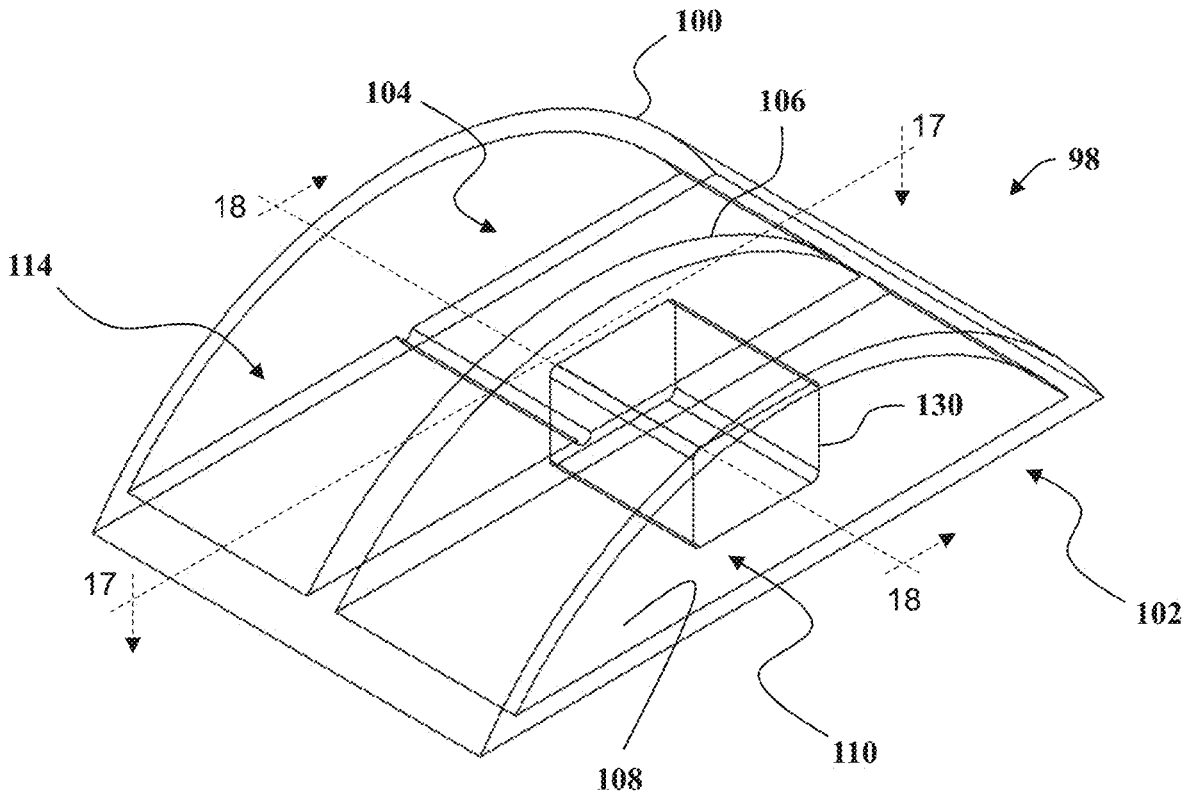
FIG. 16 is a schematic view of the connector assembly shown in FIG. 14.
Figure 17:
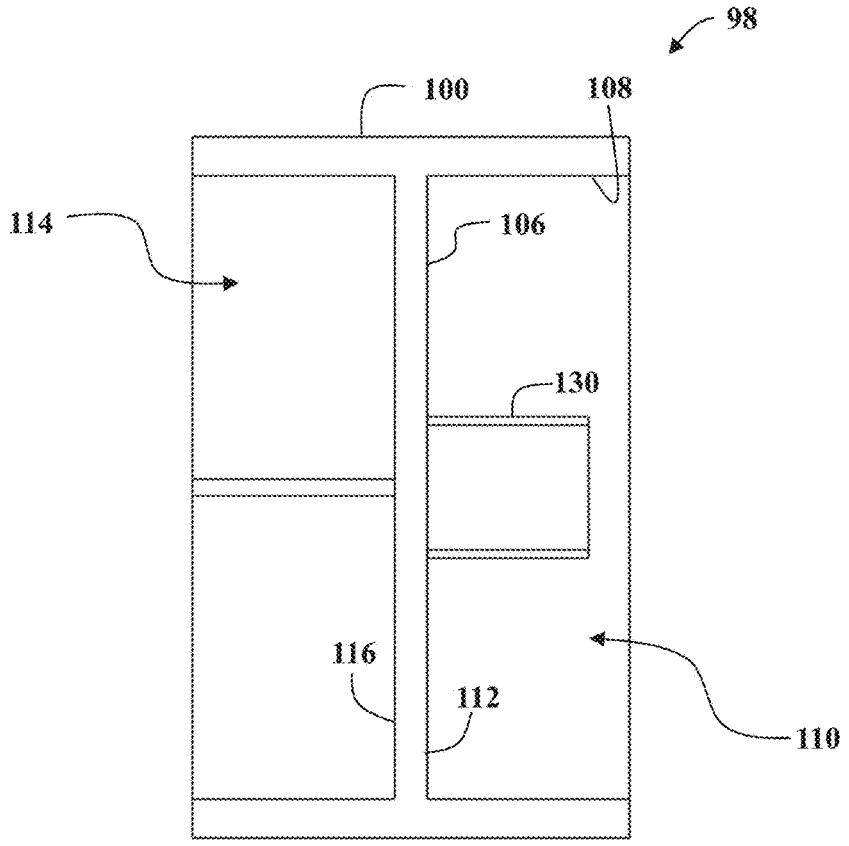
FIG. 17 is a sectional view of the connector assembly shown in FIG. 16 taken along line 17-17.
Figure 18:
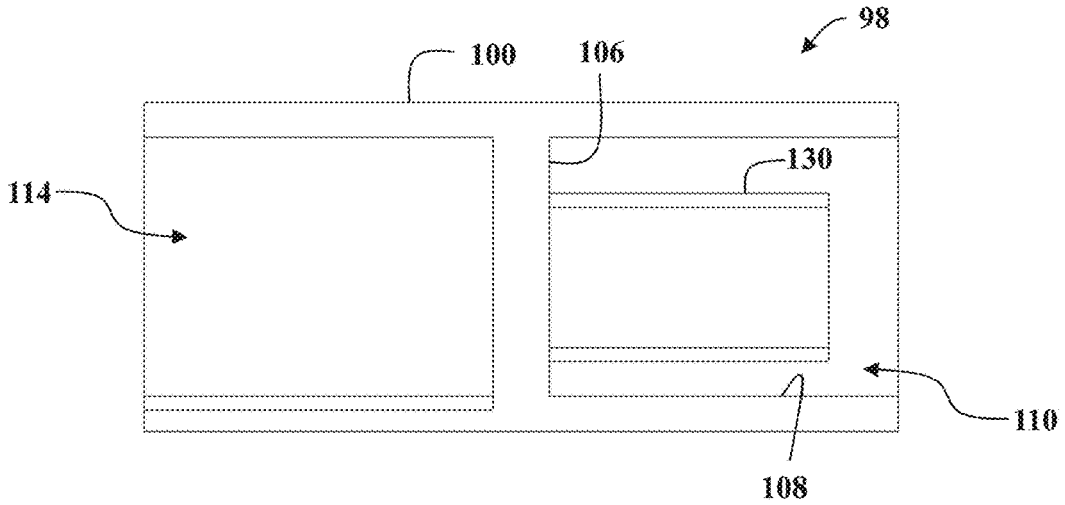
FIG. 18 is a sectional view of the connector assembly shown in FIG. 16 taken along line 18-18.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In general, the present invention describes a traffic control system 10 that may be used to control motor vehicle traffic and/or pedestrian traffic. In various embodiments, the traffic control system may be used for: Entertainment Use—Lighted Concert Walkways across walkways with cables, marking lighted concert venue control walkways and lighted exit paths; Military Applications—lighted temporary aircraft runways, signaling devices; and RV recreational use—lighted camping areas and be able to be driven over by ATV's. In addition, the system 10 may be used with disabled vehicles, and may be used in both commercial and private use for the roadside safety of the motorist. For example, the system 10 may be used in the commercial vehicle market, where a driver can place the lighted strip assemblies out behind their truck in conjunction with the federally mandated safety equipment which is not as effective as the lighted strip.

With reference to FIGS. 1-24, in the illustrated embodiment, the traffic control system 10 includes a traffic control lighted strip assembly 12 that includes a flexible transparent housing 14 and an LED light assembly 16 inserted through the flexible transparent housing 14. The LED light assembly 16 includes a plurality of light-emitting diode (LED) lights. In some embodiments, the traffic control system 10 may also include a support reel assembly 18 that is configured to support and contain the traffic control lighted strip assembly 12. The traffic control lighted strip assembly 12 is adapted to be spooled about the support reel assembly 18 to enable users to transport the traffic control lighted strip assembly 12 to various locations and deploy the traffic control lighted strip assembly 12 along a ground surface to illuminate the corresponding area of ground surface. The support reel assembly 18 also enables users to stow the traffic control lighted strip assembly 12 when not in use. In one embodiment, the support reel assembly 18 includes a battery 20 positioned within an interior cavity 22 of the support reel assembly 18. The battery 20 may be coupled to the lighted strip assembly 12 for providing electrical power to the LED light assembly 16.

The flexible transparent housing 14 includes a housing body 24 that defines a three-dimensional Cartesian coordinate system relative to the traffic control lighted strip assembly 12. The coordinate system includes three mutually perpendicular axes 26, 28, and 30 extend through the housing body 24. For example, the housing body 24 defines a longitudinal axis 26, a lateral axis 28, and a transverse axis 30. The longitudinal axis 26 extends lengthwise along the housing body 24, the lateral axis 28 extends widthwise along the housing body 24 and is orientated perpendicular to the longitudinal axis 26, and the transverse axis 30 is orientated perpendicular to the longitudinal axis 26 and to the lateral axis 28.

In the illustrated embodiment, the housing body 24 includes a plurality of sidewalls 32 that extend between a first endwall 34 and an opposite second endwall 36 along the longitudinal axis 26. The plurality of sidewalls 32 also extend between a first side 38 and an opposite second side 40 along the lateral axis 28. The housing body 24 also includes an inner surface 42 and an outer surface 44. The inner surface 42 defines a housing cavity 46 that extends between a first open end 48 that is defined at the first endwall 34 and a second open end 50 that is defined at the second endwall 36. The outer surface 44 is formed of a flexible transparent material such that the housing cavity 46 is viewable through the outer surface 44.

The housing body 24 also includes an upper sidewall 52 that is coupled to a lower sidewall 54. The upper sidewall 52 and the lower sidewall 54 each extend between the first side 38 and the second side 40 and are coupled together at each of the first side 38 and the second side 40. In addition, a center portion of the upper sidewall 52 is spaced a distance from the lower sidewall 54 along the transverse axis 30 such that the housing cavity 46 is defined between the upper sidewall 52 and the lower sidewall 54.

The upper sidewall 52 includes an arcuate outer surface 56 that is defined between the first side 38 and the second side 40 along the lateral axis 28. The lower sidewall 54 includes a planar outer surface 58 that is defined between the first side 38 and the second side 40 along the lateral axis 28. The housing body 24 also includes a housing body height 60 defined between an apex of the arcuate outer surface 56 of the upper sidewall 52 and the planar outer surface 58 of the lower sidewall 54 along the transverse axis 30. In addition, the housing body 24 includes a housing body width 62 defined between the first side 38 and the second side 40 along the lateral axis 28.

The housing body 24 also includes a plurality of support walls 64 that are positioned within the housing cavity 46 and are coupled between the upper sidewall 52 and the lower sidewall 54. Each of the support walls 64 extend along the housing cavity 46 between the first open end 48 and the second open end 50 along the longitudinal axis 26.

In one embodiment, the plurality of support walls 64 include a first support wall 66 and a second support wall 68. The second support wall 68 is spaced a distance from the first support wall 66 along the lateral axis 28 such that an LED support chamber 70 is defined between the first support wall 66 and the second support wall 68. The LED support chamber 70 extends along the longitudinal axis 26 between the first open end 48 and the second open end 50. The LED support chamber 70 is sized and shaped to receive the LED light assembly 16 therein such that the LED light assembly 16 is positioned within the LED support chamber 70.

In one embodiment, the first support wall 66 is spaced from the first side 38 of the housing body 24 such that a first chamber 72 is defined between the first support wall 66 and the first side 38. The second support wall 68 is spaced from the second side 40 of the housing body 24 such that a second chamber 74 is defined between the second support wall 68 and the second side 40. The housing body 24 may also include a reflective material 76 positioned within the first chamber 72 and/or the second chamber 74. The reflective material 76 may include reflective, colored poly-tubing inserted through the first chamber 72 and/or the second chamber 74.

In the illustrated embodiment, the LED light assembly 16 is positioned within the housing cavity 46 and extends along the longitudinal axis 26 between the first open end 48 and the second open end 50. The LED light assembly 16 includes a plurality of LED light pods 78 that are spaced along the longitudinal axis 26. The plurality of LED light pods 78 are coupled together in series such that adjacent LED light pods 78 are oriented along the longitudinal axis 26. Each LED light pod 78 includes a predefined number of LED lights 80. In one embodiment, each LED light pod 78 includes at least three LEDs 80.

In one embodiment, the traffic control lighted strip assembly 12 also includes an electrical quick connect coupler 82 that is coupled to an end of the LED light assembly 16 for connecting the LED light assembly 16 to a power source, such as battery 20, a power generator, and/or electrical outlet. In one embodiment, the electrical quick connect coupler 82 is adapted to be coupled to the battery 20 stored in the support reel assembly 18.

In the illustrated embodiment, the traffic control lighted strip assembly 12 includes one or more end caps 84. Each end cap 84 is adapted to be coupled to an end of the housing body 24. For example, the end cap 84 may be configured to be coupled to the first endwall 34 or the second endwall 36 of the housing body 24. In addition, the traffic control lighted strip assembly 12 may include a first end cap 84 coupled to the first endwall 34 of the housing body 24 and a second end cap 84 coupled to the second endwall 36 of the housing body 24. In the illustrated embodiment, the end cap 84 includes an end plate 86 and a support member 88 extending outwardly from an outer surface of the end plate 86. The support member 88 includes an outer surface that is sized and shaped to be inserted into the housing cavity 46 and/or LED support chamber 70 such that the end plate 86 abuts an endwall of the housing body 24 to enclose an open end of the housing body 24. For example, the end cap 84 may be installed at the first open end 48 of the housing body 24 such that the end plate 86 abuts the first endwall 34 to enclose the first open end 48 of the housing body 24. The end cap 84 may also be installed at the second open end 50 of the housing body 24 such that the end plate 86 abuts the second endwall 36 to enclose the second open end 50 of the housing body 24.

Figure 22:
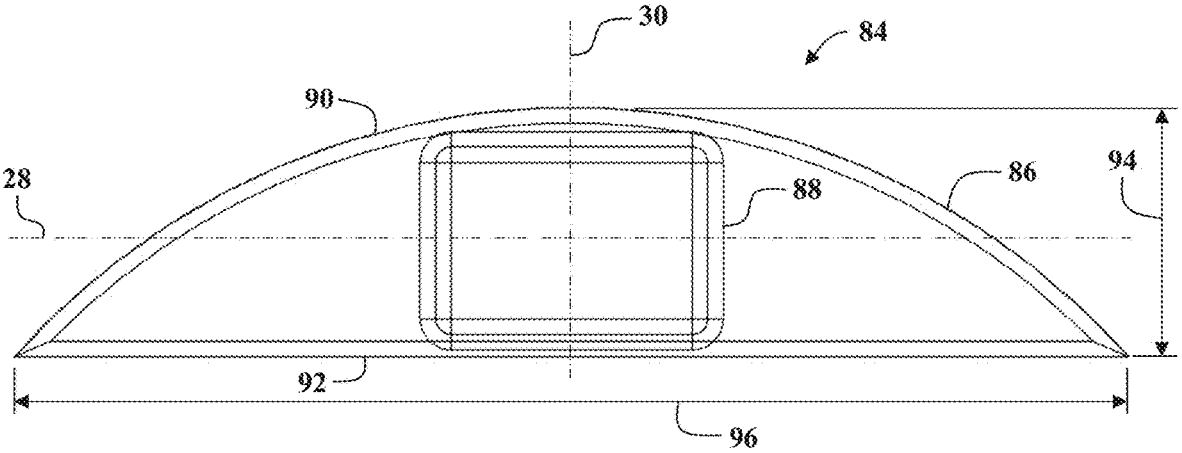
FIG. 22 is a front elevation view of the end cap shown in FIG. 20.
Figure 23:
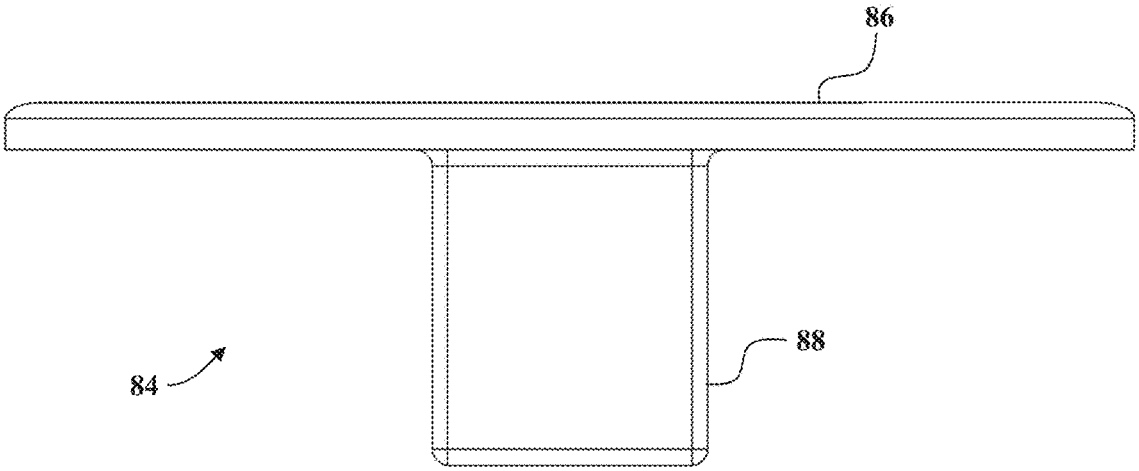
FIG. 23 is a top view of the end cap shown in FIG. 20.
Figure 24:
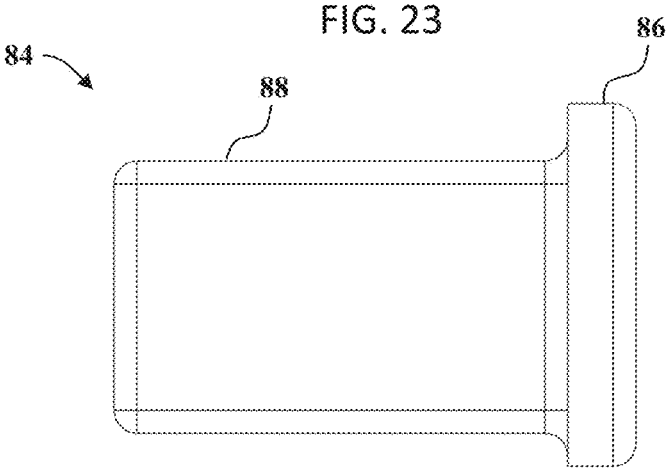
FIG. 24 is a side view of the end cap shown in FIG. 20.

The end plate 86 also includes an arcuate upper surface 90 and a planar lower surface 92 such that the end plate 86 includes a cross-sectional shape that is substantially similar to a cross-sectional shape of the housing body 24. For example, as shown in FIG. 22 the end plate 86 includes an end plate height 94 defined between an apex of the arcuate upper surface 90 and the planar lower surface 92 along the transverse axis 30, and includes an end plate width 96 defined along the planar lower surface 92 along the lateral axis 28. In the illustrated embodiment, the end plate height 94 is equal to the housing body height 60 and the end plate width 96 is equal to the housing body width 62.

Figure 19:
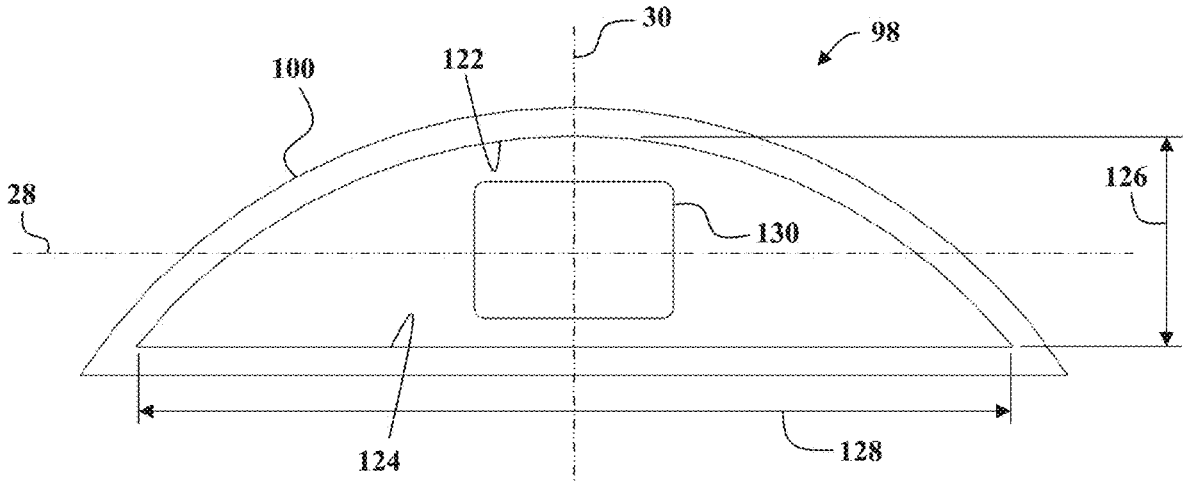
FIG. 19 is a front elevation view of the connector assembly shown in FIG. 16.
Figure 20:
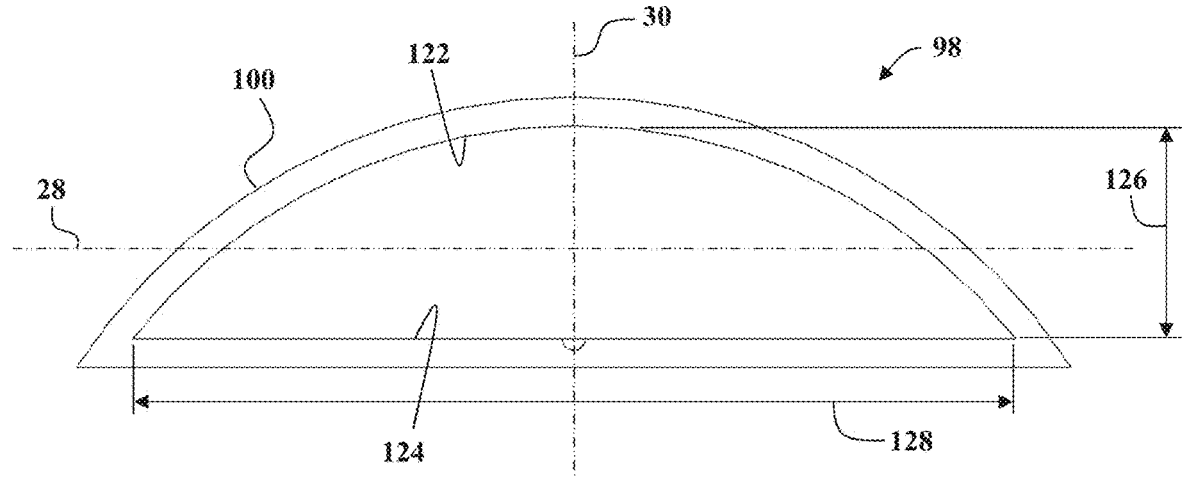
FIG. 20 is a rear elevation view of the connector assembly shown in FIG. 16.
Figure 21:
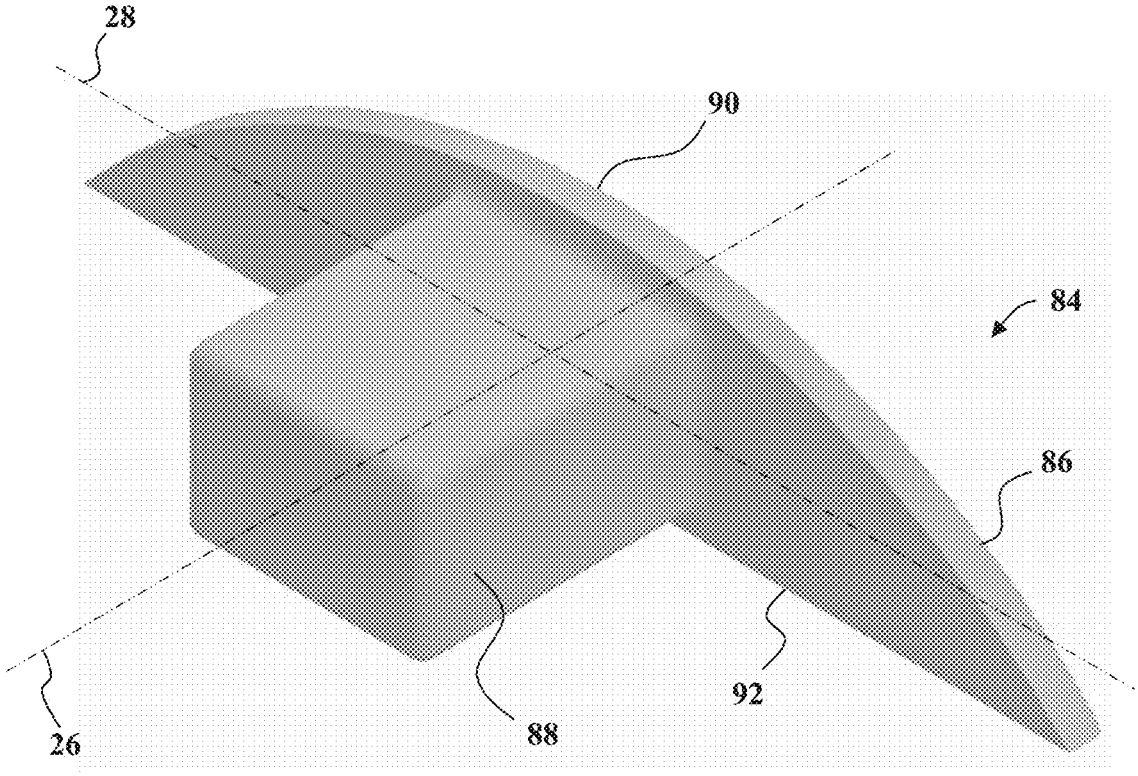
FIG. 21 is a perspective front view of an end cap that may be used with the traffic control lighted strip assembly show in FIG. 10.

In one embodiment, traffic control system 10 includes a connector assembly 98 that is adapted to be coupled between a pair of lighted strip assemblies 12. The connector assembly 98 includes a connector body 100 that extends between a first connector body open end 102 and a second connector body open end 104. The connector body 100 includes an outer surface having a shape that is substantially similar to the shape of the outer surface of the housing body 24. The connector body 100 also includes a support wall 106 that positioned between the first connector body open end 102 and the second connector body open end 104, and an inner surface 108 that defines a first connector cavity 110 defined between the first connector body open end 102 and a first side 112 of the support wall 106, and a second connector cavity 114 defined between the second connector body open end 104 and a second side 116 of the support wall 106. The first connector cavity 110 is sized and shaped to receive a first lighted strip assembly 118 therein, and the second connector cavity 114 is sized and shaped to receive a second lighted strip assembly 120 therein. For example, as shown in FIGS. 19-20, the connector body 100 includes an upper arcuate inner surface 122 and a lower planar inner surface 124 that define the first and the second connector cavities 110, 114. In addition, the connector body 100 includes a connector height 126 defined between an apex of the upper arcuate inner surface 122 and the lower planar inner surface 124, and a connector width 128 defined be the lower planar inner surface 124 along the lateral axis 28. In the illustrated embodiment, the connector height 126 is slightly larger than the housing body height 60, and the connector width 128 is larger than the housing body width 62 to enable the housing body 24 to be inserted within the cavity of connector body 100 to facilitate coupling the connector assembly 98 to one or more light strip assemblies 12.

The connector assembly 98 may also include a connector member 130 that extends outwardly from the first side 112 of the support wall 106. The connector member 130 includes an outer surface that is sized and shaped to be received within the housing cavity 46 and/or LED support chamber 70 of the lighted strip assembly 12.

The support housing 14 may be formed from a flexible plastic-rubber material having a UV protective filler to prevent degradation and/or fading from UV rays. The support housing 14 includes an inner surface that extends between a first open end and an opposite second open end and defines a cavity that extends between the first and the second open ends along a longitudinal axis. The LED light assembly 16 is positioned within the cavity and extends along the longitudinal axis between the first and second open ends.

In one embodiment, the support housing 14 may include reflective material for Daytime visibility. The reflective material may include reflective, colored poly-tubing inserted through a cavity defined along the support housing and/or reflective adhesive material adhered to an outer surface of the support housing.

The LED light assembly 16 includes a plurality of LED pods that are spaced along the longitudinal axis. Each LED pod includes a predefined number of light-emitting diode (LED) lights. In one embodiment, the LED light assembly 16 includes groups of high-intensity red LED lights that are spaced along the longitudinal axis. An electrical quick-connect coupler 82 is attached to one end of the LED light assembly 16. The electrical quick-connect coupler 82 is configured to be removably coupled to a power cord to provide electrical power to the LED light assembly 16. In the illustrated embodiment, the support housing 14 is formed of a transparent flexible rubber material that is rated to support vehicular traffic weights without collapsing the support cavity, and includes sufficient translucence such that the LED lights are easily viewable through the support housing.

The roadway traffic control system 10 also includes a support reel 18. The LED roadway lighted strip assembly 12 is spooled about the support reel to allow the LED roadway lighted strip assembly to be stored. The support reel 18 includes a center hand grip to allow a user to carry the roadway traffic control system, and a reel knob to allow the user to rotate the support reel about the center hand grip to spool the LED roadway lighted strip assembly 12 about the support reel.

The traffic control system 10 may also include a 12V battery pack that may be connected to the LED light strip to provide power to the LED light strip. The 12V battery pack may include a low-profile housing, having a somewhat flat threshold style battery in a crush resistant container.

The LED light strips 16 may be made in different lengths. For example, in some embodiments, the traffic control lighted strip assembly 12 may include a length of 10 ft, 20 ft, 30 ft, 5 ft, and/or any suitable length. In addition, multiple traffic control lighted strip assemblies may be connected together to form longer traffic control systems. The assemblies are water proof and crush resistant. The strips are lighted utilizing 12 V LED, triple light pods.

The waterproof LED pods are contained inside the clear rubber Strip. Each end of the LED string has waterproof crush resistant quick connectors which allows other strips to be added or removed quickly. In one embodiment, the LED light assembly may include a programmable controller for controlling the LED light intensity levels, and/or flashing pattern. The LED light assembly may also include a plurality of LED's having different colors and/or having the same color. For example, the LED lights may include a variety of colors, and may include a lighting controller to allow a selection of either constant or flashing pattern.

The design of the support housing 14 for the LED light strips includes a flat bottom with a rounded threshold style top. The support housing 14 with LED light assembly is designed to be laid out on to the ground and are flexible enough to be maneuvered into place. The light strips when not in use are kept on the support reel.

The support reel 18 is portable and hand held, and has a width that is wide enough to allow the light strips to lay flat when being reeled onto the reel. The support reel has a center hand hold grip that allows a user to walk while paying out the LED light strips one handed while it spools out.

The power for the light strips is connected by a shielded 12V power cord that has a water proof quick connector. This cord will allow the light LED light strips to be plugged into a vehicle 12V supply or a portable 12V battery pack.

The LED lights strips may be used for emergency traffic control and/or crowd control use, and provides better linear direction and viewing distance than current traffic control systems.

In another embodiment, the traffic control system 10 may include a lighted roadway strip assembly 12 that includes a fiber optic lighting assembly, a fluorescent lighting assembly, a halogen lighting assembly, and/or any suitable lighting assembly that may use to provide visible light through the support housing.

In addition, the traffic control system 10 may also include a portable battery coupled to lighted roadway strip assembly to provide electrical power to the lighted roadway strip assembly. For example, in one embodiment, the support housing 14 may include a battery compartment including an enclosed crush resistant, weather resistant housing. The support 14 may also include an end cap coupled to one or both ends of the support housing to form a water resistant barrier.

In one embodiment, the traffic control system 10 may include a module system of links of lighted roadway strip assemblies 12 connected together. For example, one or more lighted roadway strip assemblies 12 may include connection end caps 84 and/or connector assemblies 98 and electrical quick couplers at each end of the lighted roadway strip to enable multiple lighted roadway strip assemblies to be connected together for form longer runs of lighted assemblies.

The lighted assemblies may also include support housing end caps 84 and a connector sleeves 98 so the links of lighted strip assemblies may be connected with no gap, and concealing the quick connect to prevent crushing and/or just to store the connection and wire in.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting system, comprising:

a plurality of lighted strip assemblies coupled together, each lighted strip assembly including:

a flexible transparent housing including a housing cavity extending between a first open end and an opposite second open end and a pair of opposing support walls positioned within the housing cavity to form an LED support chamber defined between the opposing support walls and a pair of secondary chambers defined along opposite sides of the LED support chamber;

an LED light assembly positioned within the LED support chamber and extending between the first open end and the second open end, the LED light assembly including a plurality of LED light pods, each LED light pod including a predefined number of LED lights; and a reflective, colored poly-tubing positioned within at least one of the secondary chambers;

a connector assembly coupled between adjacent lighted strip assemblies, the connector assembly including a connector body extending between a first connector body open end and a second connector body open end, the connector body including:

a support wall positioned between the first connector body open end and the second connector body open end;

a first connector cavity defined between the first connector body open end and a first side of the support wall; and a second connector cavity defined between the second connector body open end and a second side of the support wall, wherein the first connector cavity is configured to receive a first adjacent lighted strip assembly and the second connector cavity is configured to receive a second adjacent lighted strip assembly.

2. The lighting system of claim 1, wherein each LED light assembly is coupled together in series.

3. The lighting system of claim 2, further comprising an electrical quick connect coupler coupled to an end of one of the LED light assemblies.

4. The lighting system of claim 1, wherein each LED light pod includes at least three LEDs.

5. The lighting system of claim 1, further comprising an end cap coupled to one of the plurality of lighted strip assemblies.

6. The lighting system of claim 5, wherein the end cap includes an end plate and a support member extending outwardly from the end plate, the support member is inserted into a corresponding housing cavity of the one of the plurality of lighted strip assemblies.

7. The lighting system of claim 6, wherein the end plate includes a cross-sectional shape that is substantially similar to a cross-sectional shape of the one of the plurality of lighted strip assemblies.

8. The lighting system of claim 1, wherein each lighted strip assembly includes an arcuate upper surface.

9. The lighting system of claim 1, wherein each lighted strip assembly includes a planar lower surface.

10. A lighting system, comprising:

a support reel assembly;

a plurality of lighted strip assemblies coupled together and adapted to be spooled about the support reel assembly, each lighted strip assembly including:

a flexible transparent housing including a housing cavity extending between a first open end and an opposite second open end and a pair of opposing support walls positioned within the housing cavity to form an LED support chamber defined between the opposing support walls and a pair of secondary chambers defined along opposite sides of the LED support chamber;

an LED light assembly positioned within the LED support chamber and extending between the first open end and the second open end, the LED light assembly including a plurality of LED light pods, each LED light pod including a predefined number of LED lights; and a reflective, colored poly-tubing positioned within at least one of the secondary chambers;

a connector assembly coupled between adjacent lighted strip assemblies, the connector assembly including a connector body extending between a first connector body open end and a second connector body open end, the connector body including:

a support wall positioned between the first connector body open end and the second connector body open end;

a first connector cavity defined between the first connector body open end and a first side of the support wall; and a second connector cavity defined between the second connector body open end and a second side of the support wall, wherein the first connector cavity is configured to receive a first adjacent lighted strip assembly and the second connector cavity is configured to receive a second adjacent lighted strip assembly.

11. The lighting system of claim 10, wherein the support reel assembly includes a battery positioned within an interior cavity of the support reel assembly, the battery coupled to the lighted strip assembly for providing electrical power to the plurality of lighted strip assemblies.

12. The lighting system of claim 10, wherein each LED light assembly is coupled together in series.

13. The lighting system of claim 12, further comprising an electrical quick connect coupler coupled to an end of one of the LED light assemblies.

14. The lighting system of claim 10, wherein each LED light pod includes at least three LEDs.

15. The lighting system of claim 10, further comprising an end cap coupled to one of the plurality of lighted strip assemblies.

16. The lighting system of claim 15, wherein the end cap includes an end plate and a support member extending outwardly from the end plate, the support member is inserted into a corresponding housing cavity of the one of the plurality of lighted strip assemblies.

17. The lighting system of claim 16, wherein the end plate includes a cross-sectional shape that is substantially similar to a cross-sectional shape of the one of the plurality of lighted strip assemblies.

18. The lighting system of claim 10, wherein each lighted strip assembly includes an arcuate upper surface and a planar lower surface.

* * * * *